United States Patent [19]

Squitieri

[11] Patent Number: 4,591,225

[45] Date of Patent: May 27, 1986

[54] ARRANGEMENT FOR INTERCONNECTING A PRINTED CIRCUIT BOARD WITH A MULTI-CONDUCTOR CABLE

[75] Inventor: Andrew Squitieri, Downers Grove, Ill.

[73] Assignee: Molex Incorporated, Lisle, Ill.

[21] Appl. No.: 691,327

[22] Filed: Jan. 14, 1985

[51] Int. Cl.[4] ..... H01R 4/24

[52] U.S. Cl. ..... 339/99 R

[58] Field of Search ..... 339/17 LC, 97 R, 97 P, 339/98, 99 R

[56] References Cited

U.S. PATENT DOCUMENTS

| | | | |
|---|---|---|---|
| 3,202,954 | 8/1965 | Kinkaid | 339/17 LC |
| 4,127,312 | 11/1978 | Fleischhacker | 339/99 R |
| 4,449,767 | 5/1984 | Weidler | 339/17 LC |

FOREIGN PATENT DOCUMENTS

| | | | |
|---|---|---|---|
| 943497 | 12/1963 | United Kingdom | 339/17 LC |

*Primary Examiner*—Joseph H. McGlynn

*Attorney, Agent, or Firm*—Louis A. Hecht; Bruce R. Mansfield

[57] ABSTRACT

Disclosed is a plug and receptacle connector arrangement for interconnecting a printed circuit board with a multi-conductor flat cable. The receptacle assembly includes terminals of the tuning fork type, and a housing which is mounted to an edge of a printed circuit board. The plug assembly includes a plurality of U-shaped channels having two parallel spaced-apart cable engaging walls joined by a common bight portion. One end of the bight portion comprises a plug terminal contact surface which is received by the tuning fork receptacle terminals. At the opposing end of the terminal, each wall cable engaging includes an insulation displacement termination portion for interconnection to the flat cable. Right angle and straight (in-line) embodiment of the invention are disclosed. The connector arrangement is particularly advantageous when used in a vibrating environment of an automobile or other moving vehicle.

9 Claims, 15 Drawing Figures

ARRANGEMENT FOR INTERCONNECTING A PRINTED CIRCUIT BOARD WITH A MULTI-CONDUCTOR CABLE

BACKGROUND OF THE INVENTION

1. Field of the Invention

This invention pertains to plug and receptacle connector assemblies which interconnect a printed circuit board with a multi-conductor cable, particularly a round conductor flat cable. In particular, the present invention pertains to arrangements of tuning-fork type receptacle terminals, and plug terminals having insulation displacement portions for connection to a multi-conductor flat cable.

2. Brief Description of the Prior Art

Several arrangements employing so-called tuning fork contacts have been employed to provide electrical connection to printed circuit boards. One example of a prior art arrangement is found in U.S. Pat. No. 4,402,564 issued Sept. 6, 1983 to Robert H. Frantz. The arrangement described therein includes a tuning fork type receptacle connector having solder tails aligned with the contacts for mounting to a printed circuit board or the like. The receptacle connector is provided with an insulated housing extending above the printed circuit board to which the connector is mounted. A mating plug member includes a dielectric housing with an opening in its mating end dimensioned to receive the receptacle housing. The plug member is loaded with a plurality of square post terminals which are received between the resilient arms of the tuning fork contacts. The plug member is adapted for connection to a conventional flat flexible multiple conductor cable, the plug terminals being clinched around the conducting circuit portions of the flat flexible cable arrangement. The square post design of the plug terminal presents a minimum surface contact area to the tuning fork contacts, with any slight lateral displacement or misalignment breaking the connection, due to the relatively narrow lateral dimensions of the square posts terminals. Further, while a convenient connection to a flat flexible multi-conductor cable is provided, a connection to a round conductor flat cable configuration would be desirable.

Another example of a prior art circuit board connector is found in an arrangement offered for sale by Molex Incorporated, Assignee of the present invention. The arrangement, a combination of the two catalog part Nos. 5512 and 5513, provides a board-to-board interconnection system. Included are plug and receptacle connectors having solder tails for conventional mounting to their respective printed circuit boards. The terminals of the receptacle connector include tuning fork contacts with solder tails extending either in line therewith, or bent over at right angles thereto. A plurality of receptacle terminals are enclosed within a dielectric housing which has a mounting face with a series of spaced-apart openings communicating with the receptacle terminals. The plug member includes a conventional rectangular wafer having a plurality of blade-type terminals mounted therein. Solder tails formed as an extension of the elongated blade terminals are provided for conventional mounting to the printed circuit board, with the wafer providing a mounting wall for the plug connector. The blade-type terminals are partially shrouded by three surrounding sidewalls integrally formed and extending from three sides of the rectangular wafer. The plug walls form a cavity dimensioned to receive the receptacle housing. While providing an improved contact surface realized by the increased width of the blade terminals, forces applied to the plug connector when mated with the receptacle connector tend to separate the arms of the tuning fork contacts, thus compromising the integrity of the separable electrical connection. Further, the arrangement provided is one for interconnecting two printed circuit boards directly, without benefit of a jumper cable. Neither of the arrangements are especially suited for a high vibration environment, as is found in automobiles and other moving vehicles.

SUMMARY OF THE INVENTION

It is, therefore, an object of the present invention to provide a plug and receptacle connector arrangement for interconnecting a printed circuit board with a flat, ribbon cable of the round conductor type.

Another object of the present invention is to provide a plug assembly for the connector arrangement having an insulation displacing termination portion providing ready interconnection with the round conductor flat cable.

Another object of the present invention is to provide a plug assembly having an inexpensive plug terminal wherein the slideable connecting portion of the terminal does not require coining or the like forming operations.

Still another object of the present invention is to provide a plug and receptacle arrangement which offers improved contact integrity despite forces inparted to the plug assembly in directions normal to the direction of plug insertion. In particular, it is an object of the present invention to reduce or eliminate the effect of strain forces which tend to separate the resilient arms of the tunign fork contacts, while providing a plug contact surface which insures continued contact under variously directed strain forces as might be experienced in a moving vehicle or the like environment.

These and other objects of the present invention are provided in an improved electrical connector arrangement for interconnecting an external circuit member to an insulated cable having a plurality of conductors surrounded by electrical insulation. The connector arrangement includes a receptacle connector having a housing with a plurality of integral, stamped, metallic receptacle terminals mounted therein each having a mating end defining a tuning fork portion with opposed spaced-apart contacting surfaces and an opposite end for electrical association with said external circuit member. The arrangement also includes a plug connector mateable with said receptacle connector having a plug housing with a plurality plug terminals mounted therein each having a mating end defining a generally flat blade portion adapted to be received between and in electrical contact with the contact surfaces of the tuning fork portion and a cable engaging end for electrical connection to the cable. The improvement in the plug terminals comprises an elongated, integral, stamped, metallic, generally L-shaped channel extending between said cable engaging end and said mating end and including a first elongated terminal wall and a second terminal wall extending laterally of a longitudinal edge of said first wall, the first wall having the blade portion at the mating end thereof and the second wall having an insulation displacement slot formed therein at the cable engaging end to receive the insulated cable therein and displace the insulation to electrically contact one of the conductors.

BRIEF DESCRIPTION OF THE DRAWINGS

In the drawings, wherein like elements are referenced alike.

DETAILED DESCRIPTION OF THE PREFERRED EMBODIMENT

According to the present invention, a connector assembly is provided for interconnecting an external circuit member, such as a printed circuit board, to a round conductor flat cable. Two embodiments of the present invention are described herein: a right angle connector assembly shown in FIGS. 1–7; and a straight or in-line connector assembly shown in FIGS. 8–12.

Figure 1:
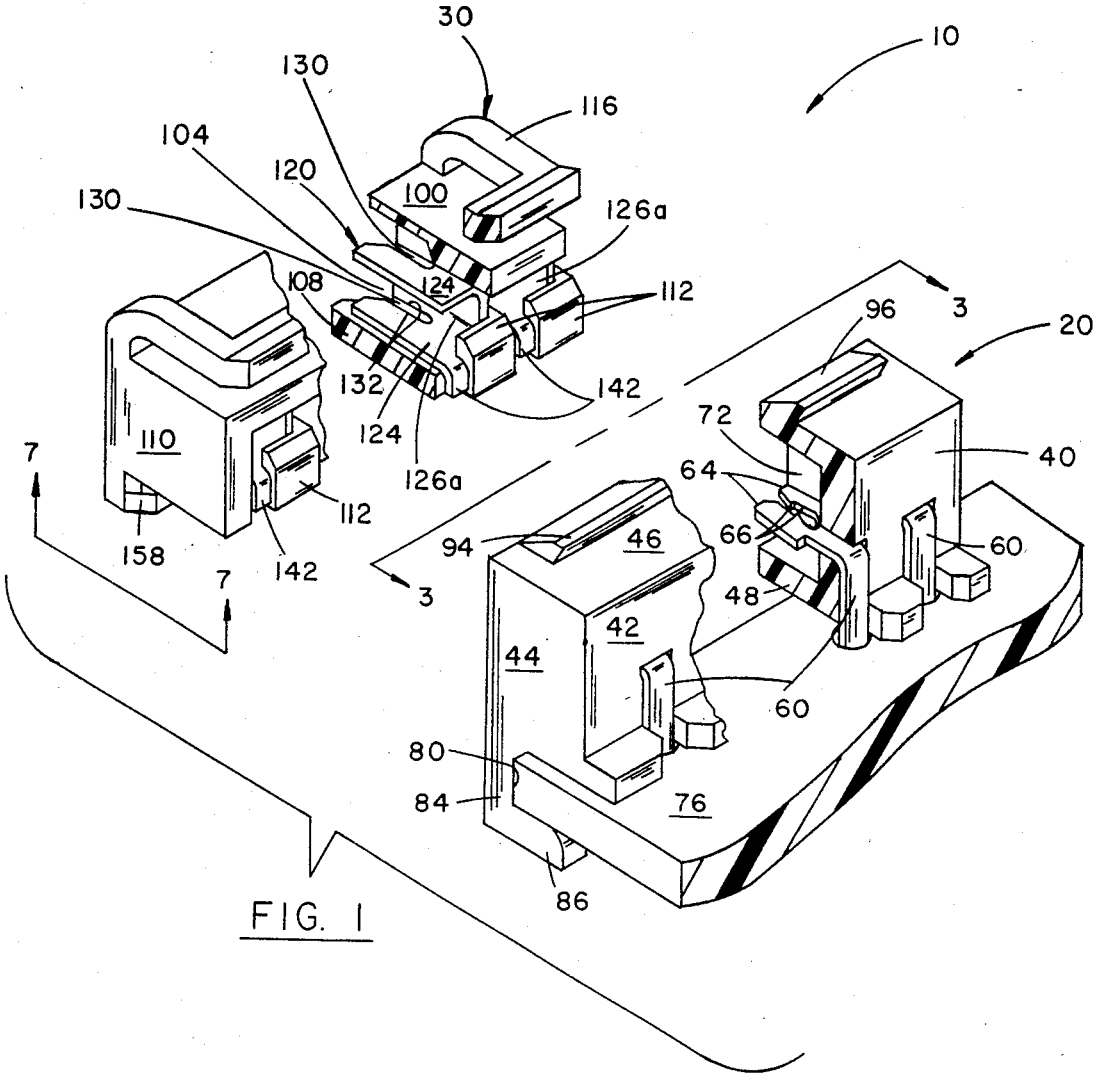
FIG. 1 is an exploded perspective view of a right angle connector assembly of the present invention.
Figure 2:
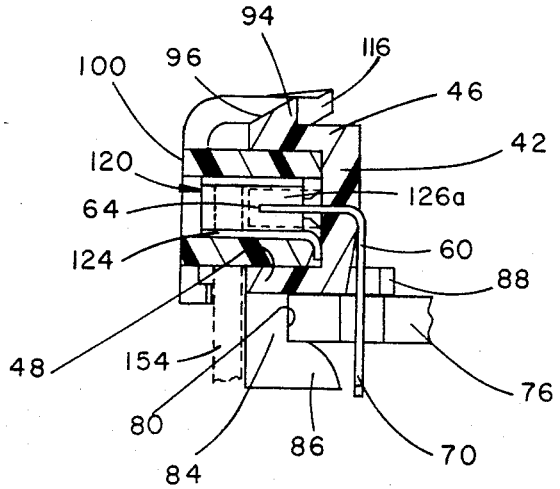
FIG. 2 is a cross sectional view of the mated assembly of FIG. 1.

Referring now to FIGS. 1–7, and in particular to FIG. 1, a right angle connector assembly generally shown at 10 comprises a receptacle connector assembly 20 and a plug assembly 30. As will be described herein, receptacle assembly 20 includes a co-planar array of tuning fork-like receptacle terminals disposed parallel to the printed circuit board to which the receptacle assembly is mounted, and the plug assembly 30 includes U-channel terminals having insulation displacing wire connecting portions at their rearward ends. As indicated in FIG. 2, the mating end of plug assembly 30 is received within the receptacle assembly 20, with a resilient strap-like latching means holding the two connector assemblies together.

Figure 3:
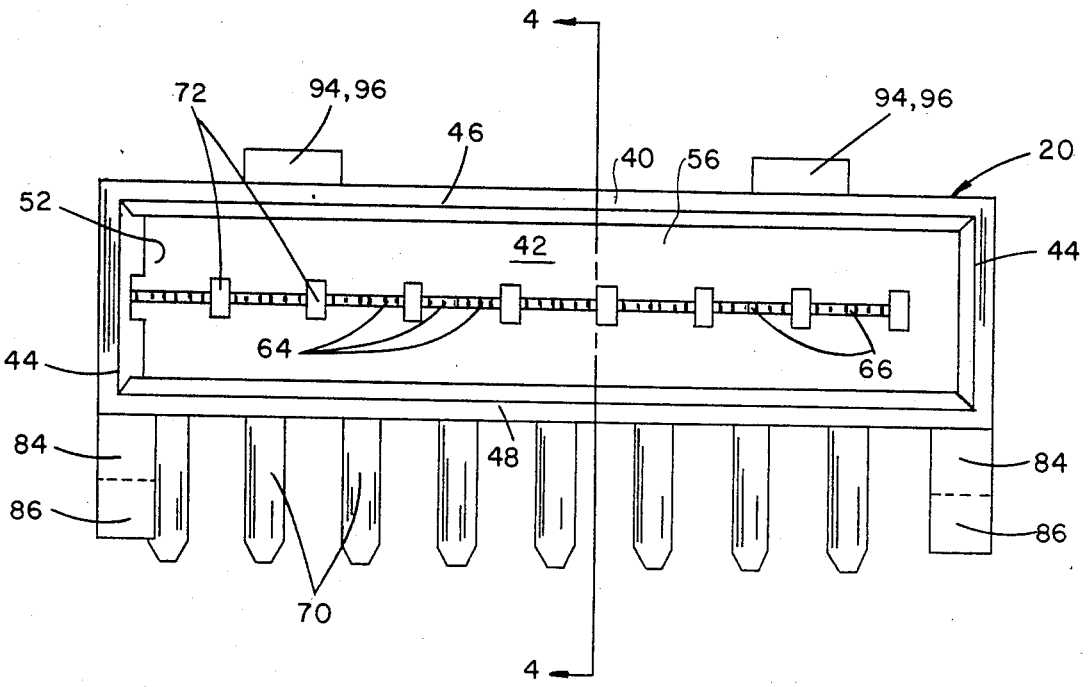
FIG. 3 is a front elevation view of the receptacle assembly portion of FIGS. 1 and 2.

Referring now to FIG. 3, a front elevation view of connector assembly 20 is shown prior to its mounting to a printed circuit board. Receptacle assembly 20 includes a dielectric housing 40 having a rearward terminal mounting wall 42 with sidewalls 44, top wall 46 and bottom sidewall 48 extending therefrom to form a plug receiving cavity 52. Housing 40 is preferably formed of a single integral molded assembly, with the free end of the sidewalls 44–48 forming a plug receiving opening 56. As shown most clearly in FIG. 1, a plurality of receptacle terminals 60 are mounted in housing 40 to form a coplanar array of tuning fork-like receptacle terminals extending parallel to the printed circuit board on the surface. Terminals 60 each include a pair of arm-like portions 64 having opposed spaced apart contacting surfaces 66 which slidingly receive the plug terminals when the connector assemblies are mated. Opposing ends of terminals 60 include pin-like solder tails 70 (see FIG. 2) which are received in apertures in the printed circuit board, being secured to the circuit traces thereof by solder, for electrical connection to an external circuit member, as is known in the art. Integrally formed with housing 40 is a plurality of arm-like walls 72 disposed between adjacent receptacles 60.

Figure 4:
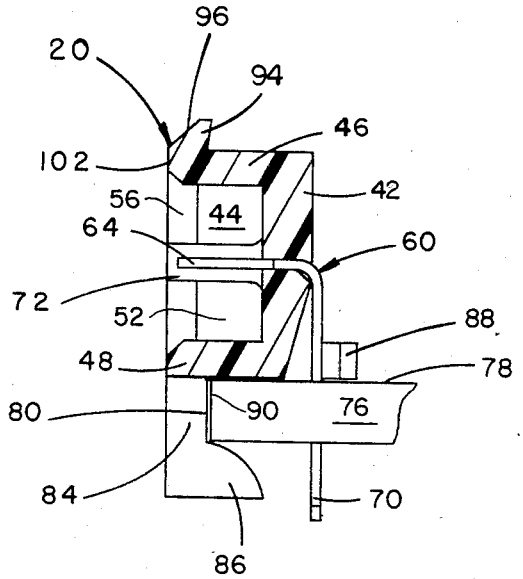
FIG. 4 is a cross sectional elevation view taken along the line 4—4 of the receptacle assembly of FIG. 3.
Figure 6:
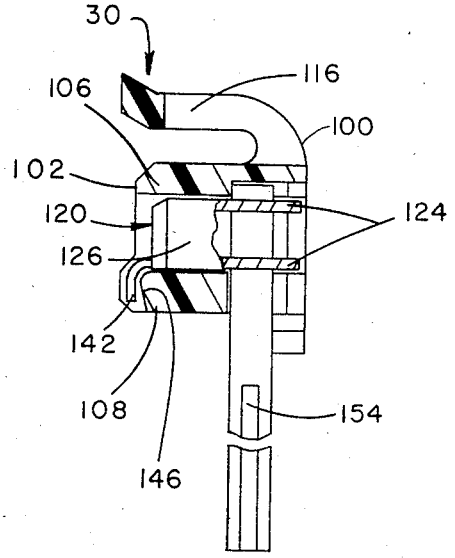
FIG. 6 is a cross sectional view taken along the line of 6—6 of FIG. 5.

FIGS. 1 and 2 and 4 show housing 40 mounted to a printed circuit board 76 having an upper mounting surface 78 and a mating edge 80. When installed in printed circuit board 76, solder tails 70 are received in apertures formed in printed circuit board 76, with bottom sidewall 48 contacting upper printed circuit board surface 78. Integrally formed with housing 40 are downwardly extending board engaging latches 84 with resilient camming ears 86 located at their free ends. Integrally formed with rearwall 42 are mounting tabs 88 formed as rearward extension of bottom housing wall 48, which also engages the upper printed circuit board surface 78. When installed in printed circuit board 76, receptacle assembly 20 is lowered onto the printed circuit board such that terminals 60 are received in the printed circuit board apertures with only mounting tabs 88 engaging upper printed circuit board surface 78. Thereafter, housing 40 is pivoted or rotated such that camming ears 86 slide against printed circuit board mating edge 80 until housing 40 is fully seated, with ears 86 engaging the underside surface of printed circuit board 76, and printed circuit board edge 80 being received within the mounting channel 90 formed by bottom housing wall 48, board engaging latches 84 and camming ears 86. The material from which housing 40 is molded is chosen such that board engaging latches 84 are deflectable with respect to bottom wall 48 and camming ears are likewise deflectable with respect to edges 84. As a result, housing 40 is mounted about printed circuit board mating edge 80 with a snap fit. Thereafter, solder tail portions 70 are soldered to the circuit traces of printed circuit board 76 utilizing conventional techniques. Integrally formed with housing 40 are latching ramps 94 formed as an outward extension of upper housing wall 46, and presenting a camming surface 96 adjacent the mating face of housing 40.

Referring now to FIGS. 1, 2, and 5–7, plug assembly 30 includes a plug housing 100 with a mounting face 102 in a plurality of terminal receiving cavities 104. Housing 100 is integrally molded to include top and bottom walls 106, 108, respectively and side walls 110. Integrally formed with bottom wall 108 adjacent its mounting end are front walls 112 which, as will be described herein, provide a stop surface for the back loaded plug terminals. A C-shaped strap member 116 integrally formed with upper wall 106 forms a resilient latch engaging latching ramps 94 of the receptacle assembly to retain the plug and receptacle assemblies in a mated condition.

Figure 5:
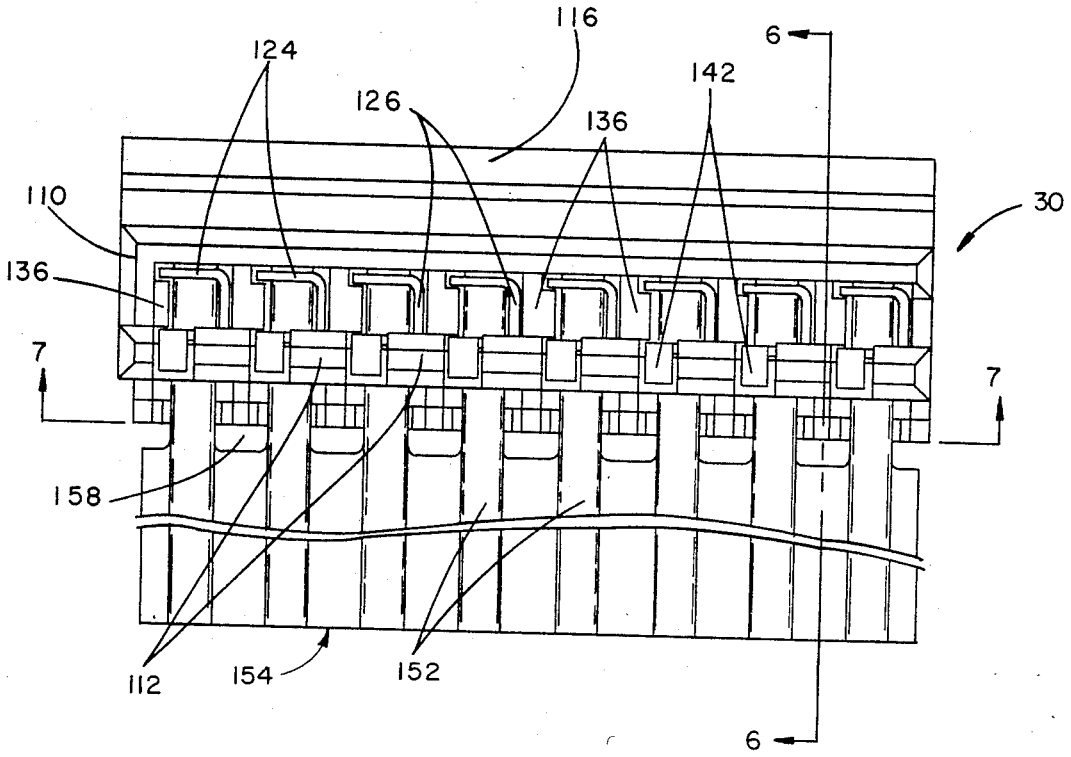
FIG. 5 is a front elevation view of the plug assembly portion of FIGS. 1 and 2.
Figure 7:
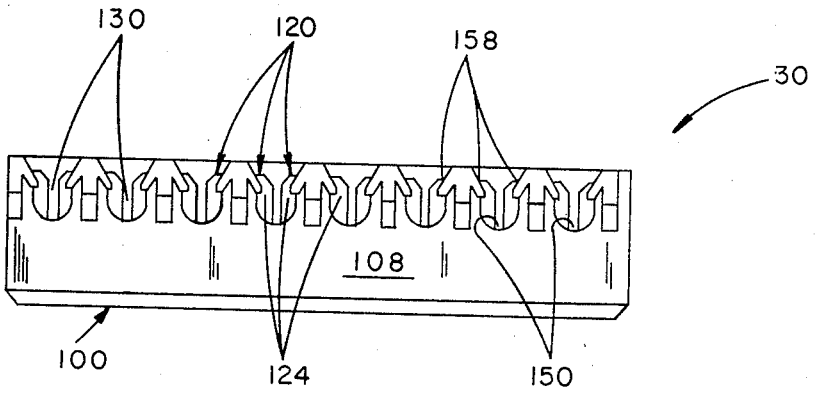
FIG. 7 is a bottom view of the plug assembly of FIGS. 1, 2, 5 and 6.

A plurality of plug terminals 120 are received within the cavities 104 of plug housing 100 by being back loaded, or received in rearward facing openings in each cavity. Plug terminal 120 comprises a U-shaped channel having a pair of conductor engaging terminal walls 124 joined to an intermediate terminal wall or bight portion 126. The forward flat blade portion 126*a* of bight 126 comprises a receptacle terminal engaging portion, which cams against contact surfaces 66 as it is received within the arms 64 of receptacle terminal 60. The opposed rearward end of terminal 120 comprises an insulation displacement termination portion defined by inwardly extending conductor receiving slots 130 which form opposed insulation cutting edges 132. As can be seen in FIG. 5, the free ends of opposed terminal walls 124 engage a terminal support wall 136 integrally formed with plug housing 100, adjacent its rearward end. Terminal receiving cavities 104 communicate with the rearward face of plug housing 100, thereby allowing terminals 120 to be backloaded into the plug housing. Upon insertion, sidewalls 124 of terminal 120 engage support wall 136 at their rearward end, the forward end of terminal 120 engaging front walls 112 when fully inserted. Thereafter, a locking tab 142 integrally formed with the forward end of one terminal sidewall is bent over against the forward end 146 of bottom wall 108 to hold terminals 120 captive within plug housing 100. As can be seen in the bottom view of FIG. 7, bottom wall 108 includes enlarged cable receiving openings 150 adjacent the cable receiving terminal slots 130.

Individual conductor portions 152 of a round conductor flat cable 154 are received within cable receiving slots 130, 150 with the insulation cutting edges 132 of terminal slots 130 slicing through the conductor insulation so as to make contact with the signal conductors contained within cable portions 152. After termination in respective plug terminals 120, conductor portions 152 are engaged by strain relief ears 158, integrally formed with housing 100 adjacent its bottom wall 108. As will be appreciated by those skilled in the art, plug assembly 30 can be mass terminated for economy of manufacture.

Figure 8:
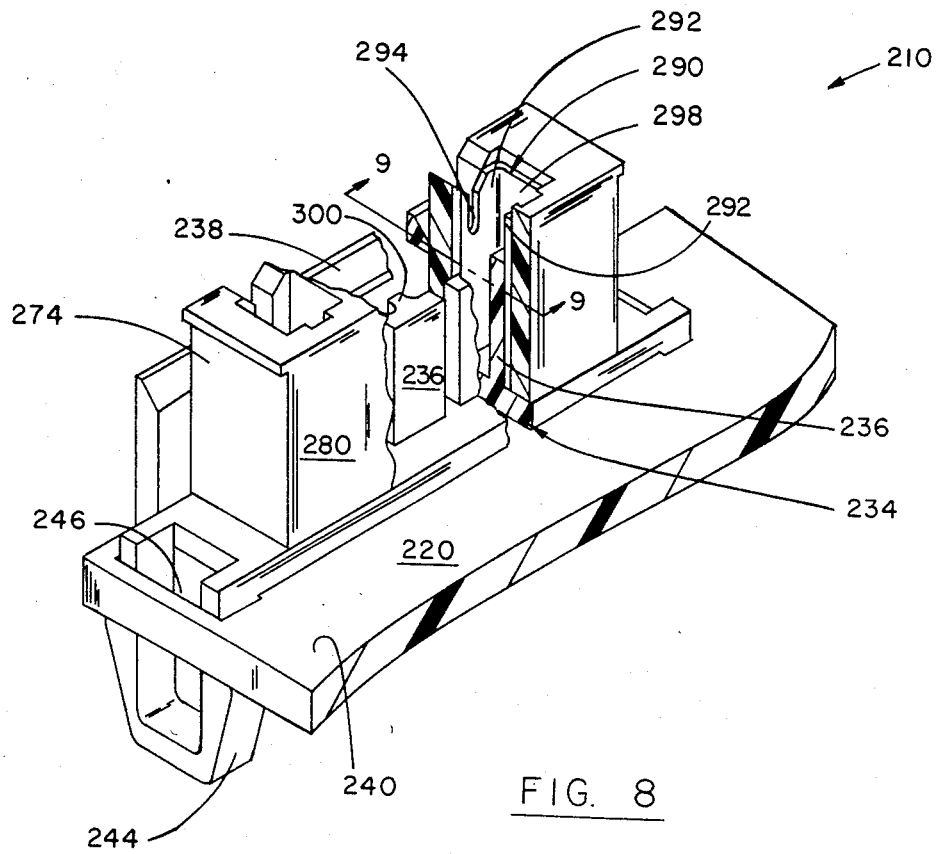
FIG. 8 is a partial perspective view of the straight or inline embodiment of the connector assembly according to the present invention.
Figure 9:
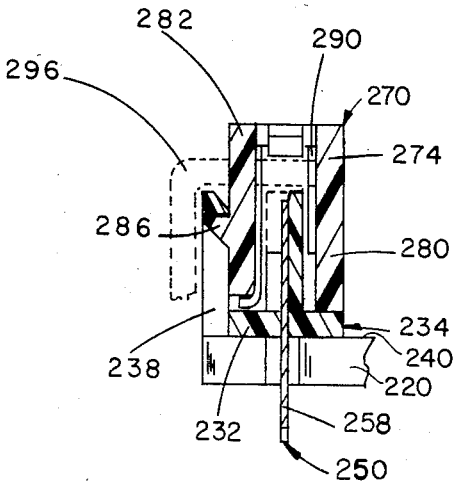
FIG. 9 is a cross sectional view taken along the line 9—9 of FIG. 8.
Figure 11:
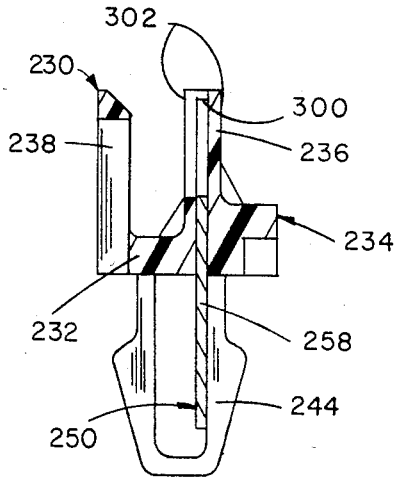
FIG. 11 is a cross sectional view taken along the lines 11—11 of FIG. 10.
Figure 10:
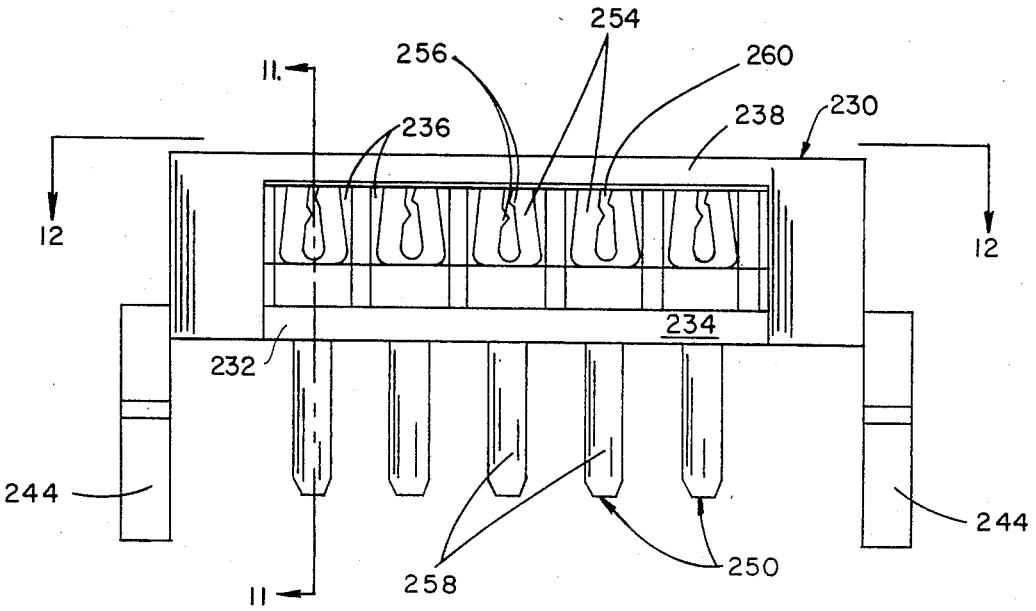
FIG. 10 is a front elevation view of the receptacle assembly portion of FIG. 8.
Figure 12:
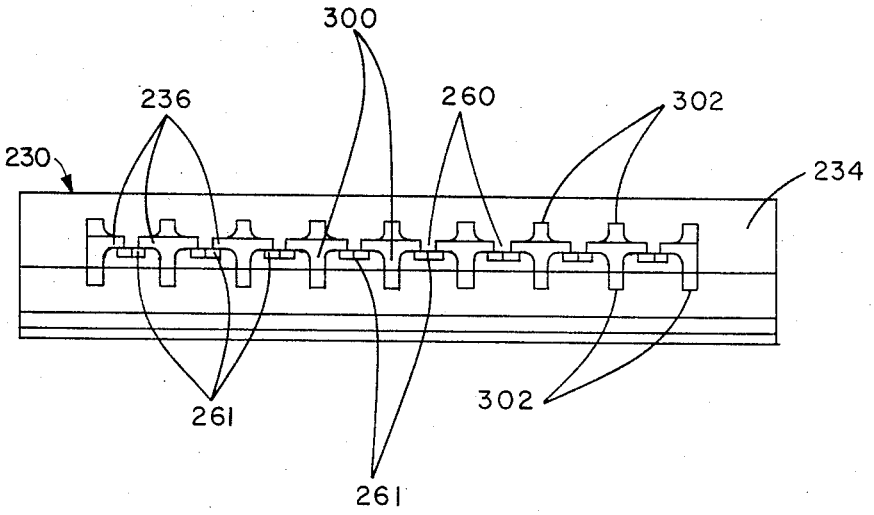
FIG. 12 a plan view of the receptacle assembly of FIGS. 10 and 11.
Figure 13A:
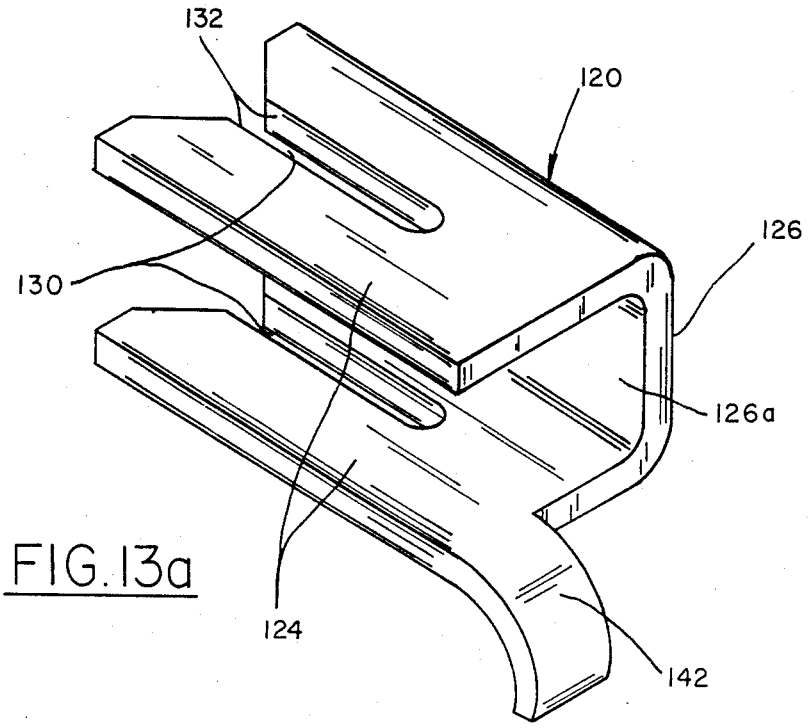
FIGS. 13*a*–13*c* show the plug terminal of the preceeding Figures, as installed in the plug housing.
Figure 13B:
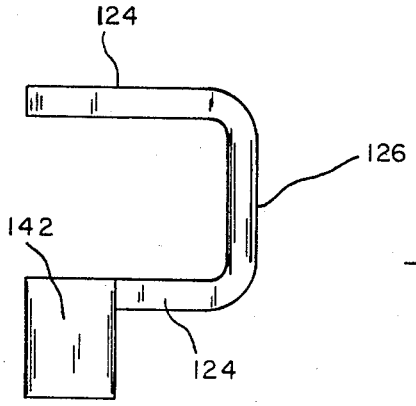
Figure 13C:
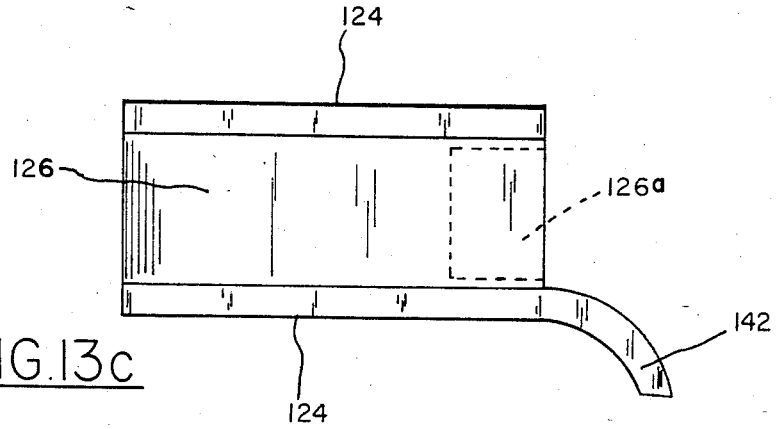

Referring now to FIGS. 8–12, the straight, in-line embodiment of the present invention indicated generally at 210, is shown. FIGS. 10–12 show the receptacle assembly portion 230 of arrangement 210 in greater detail. Receptacle assembly 230 includes a wafer-like housing 234 having a bottom mounting wall 232 and an upstanding vertical support 236. A generally C-shaped upstanding latch member 238 provides engagement with the plug housing, when the plug and receptacle assembly are mated for separable electrical connection. As indicated in FIGS. 8 and 9, bottom housing wall 232 engages the upper mounting surface 240 of a printed circuit board 220. Resilient keystone-shaped latching ears 244 are integrally formed with each longitudinal end of receptacle housing 234, being received within mounting apertures 246 formed in printed circuit board 220. Straight-line receptacle terminals 250 are, except for their unbent condition, identical to the receptacle terminals 60 of the right angle embodiment of FIGS. 1–7. Referring especially to FIG. 10, terminals 250 have tuning fork-type contacting portions comprising pairs of spaced apart resilient arms 254, each arm carrying a camming contact surface 256 for engagement with the plug terminal. The opposing ends of terminals 250 include pin-like solder tail portions 258 for conventional securement to the circuit traces of printed circuit board 220. Upstanding support wall 236 maintains the desired flat configuration of terminals 250 during mating with the plug connector. Receptacle terminals 250 are also supported by mounting in apertures formed in bottom wall 234. As can be seen in the plan view of FIG. 12, vertical support wall 236 is discontinuous, having slot portions 260 adjacent each receptacle terminal to accommodate of the plug terminal when the plug and connector assemblies are mated. For purposes of clarity, the receptacle terminals 250 have been omitted from the plan view of FIG. 12.

The plug assembly 270, shown in cross section in FIG. 9, is substantially identical to the plug assembly 30 of the right angle embodiment of FIGS. 1–7. The housing portion 274 of plug 270 has been modified slightly compared to plug housing 100, in that the C-shaped strap 116 and the cable engaging ears 158 of housing 100 have been omitted from top and bottom plug housing walls 280, 282, of plug 270, respectively. A latching ramp 286 is integrally formed with bottom housing wall 282 so as to engage the bail-portion of receptacle latch 238. The loading of receptacle terminals 290, their support within plug housing 274, and the configuration of the plug terminals themselves, is identical to the right angle embodiment shown in FIGS. 1–7. As shown in FIG. 8, plug terminal 290 includes conductor engaging walls 292, each of which has a conductor receiving slot 294 of the insulation displacing type for establishing electrical connection with a conductor 296, as indicated in phantom lines in FIG. 9. A contacting bight portion 298 formed between conductive receiving walls 292 has a forward contact engaging end for mating contact with the receptacle terminal.

When mated with the receptacle trminals, the plug assembly 280 is supported by conductor support walls 300, integrally formed with vertical support walls 236. That is, conductor receiving walls 292 of the plug terminal 290 are positioned adjacent the end portions 302 of the plug terminal support walls 300 (FIG. 11). This arrangement is similar to the finger-like terminal support walls 136 of the previously described right angle embodiment. Thus, when a plug and receptacle assemblies are fully mated, the sidewalls of plug housing 274 is supported by the outer surfaces of the array of vertical support walls 236 and plug terminals support members 300.

As will be readily appreciated by those skilled in the art, the plug terminals described above can be modified to include only one cable receiving wall, thereby forming a plug terminal which is L-shaped in cross section, rather than U-shaped. In this L-shaped embodiment, the two terminal walls will be joined along a common longitudinal edge, each having a mating end and a cable receiving end. The first terminal wall will have the blade portion adjacent its mating end, and the second terminal wall will have an insulation displacing termination portion adjacent its cable receiving end to contact the cable conductor.

I claim:

1. An electrical connector arrangement for interconnecting an external circuit member to an insulated cable having a plurality of conductors surrounded by electrical insulation, the connector arrangement including a receptacle connector having a housing with a plurality of integral, stamped, metallic receptacle terminals mounted therein each having a mating end defining a tuning fork portion with opposed spaced-apart contacting surfaces and an opposite end for electrical association with said external circuit member, a plug connector mateable with said receptacle connector having a plug housing with a plurality of plug terminals mounted therein each having a mating end defining a generally flat blade portion adapted to be received between and in electrical contact with the contact surfaces of the tuning fork portion and a cable engaging end for electrical connection to the cable, the improvement in said plug terminals comprising:

an elongated, integral, stamped, metallic, generally U-shaped channel extending between opposing cable engaging and mating ends and including a first elongated terminal wall, a second terminal wall extending laterally of a longitudinal edge of said first wall, and a third terminal wall spaced-apart and parallel to said second terminal wall and extending laterally from an opposite longitudinal edge of the first wall to define said U-shaped channel, the first wall having the blade portion at the mating end thereof and the second and third walls each having an insulation displacement slot formed therein and extending from the able engaging end thereof, the slots aligned with each other to receive the insulated cable therein and displace the insulation to electrically contact one of the conductors.

2. The arrangement of claim 1 wherein said plug housing has opposite mating and cable receiving ends, a plurality of terminal receiving cavities with openings adjacent the cable receiving end of the housing for receiving said plug terminals; and said second terminal walls include housing engaging means adjacent their mating end for engaging the plug housing mating end to prevent withdrawal of the plug terminals through said plug housing cable receiving end.

3. The arrangement of claim 2 wherin the external circuit member comprises a printed circuit board having a mounting surface, the receptacle housing includes a terminal mounting wall for engaging said printed circuit board mounting surface and a terminal support wall extending generally transverse thereto between adjacent receptacle terminals, and said receptacle terminals are mounted in said mounting wall with said contacting portions thereof immediately adjacent said support wall and said opposite ends thereof extending beyond said mounting wall; and said plug housing includes sidewalls surrounding said plug terminal and defining a mating passageway dimensioned to receive the support wall when the plug and receptacle connectors are mated for separable electrical connection.

4. The arrangement of claim 1 wherein said external circuit member comprises a printed circuit board having a mounting surface, and said plug terminal contact surfaces are stamped from a flat blank such that said contacting portions have major surfaces extending parallel to said printed circuit board mounting surface.

5. The arrangement of claim 4 wherein the opposite end of said receptacle terminals comprise solder tails formed at right angles to said contacting portions to provide engagement with said printed circuit board.

6. An electrical connector arrangement for interconnecting an external circuit member to an insulated cable having a plurality of conductors surrounded by electrical insulation, the connector arrangement including a receptacle connector having a housing with an integral, stamped, metallic receptacle terminal mounted therein having a mating end defining a tuning fork portion with opposed spacedapart contacting surfaces and an opposite end for electrical association with said external circuit member, a plug connector mateable with said receptacle connector having a plug housing with a plug terminal mounted therein having a mating end defining a generally flat blade portion adapted to be received between and in electrical contact with the contact surfaces of the tuning fork portion and a cable engaging end for electrical connection to the cable, the improvement in said plug terminal comprising:

an elongated, integral, stamped, metallic, generally U-shaped channel extending between opposing cable engaging and mating ends and including a first elongated terminal wall, a second terminal wall extending laterally of a longitudinal edge of said first wall, and a third terminal wall spaced-apart and parallel to said second terminal wall and extending laterally from an opposite edge of the first wall to define said U-shaped channel, the first wall having the blade portion at the mating end thereof and the second and third walls each having an insulation displacement slot formed therein and extending from the cable engaging end thereof, the slots aligned with each other to receive the insulated cable therein and displace the insulation to electrically contact one of the conductors.

7. The arrangement of claim 6 wherein said external circuit member comprises a printed circuit board having a mounting hole formed therein, and the opposite end of the receptacle terminal comprises a solder tail for insertion in said mounting hole for electrical association with said printed circuit board.

8. The arrangement of claim 6 wherein the plug housing includes a supporting wall projecting between said second and said third terminal walls adjacent the cable engaging ends thereof to support the cable receiving end of the plug terminal.

9. The arrangement of 6 wherein said plug housing has opposing mating and cable receiving ends, a terminal receiving cavity with an opening adjacent the cable receiving end of the housing for receiving said plug terminal; and said second terminal wall including housing engaging means adjacent its mating end for engaging the plug housing mating end to prevent withdrawal of the plug terminal through said plug housing cable receiving end.

* * * * *